US005139145A

United States Patent [19]

Cook

[11] Patent Number: 5,139,145

[45] Date of Patent: Aug. 18, 1992

[54] ADJUSTABLE LOAD COVER FOR USE WITH VARIOUS SIZES OF RECTANGULARLY TOPPED STACKS OF PALLETIZED MATERIAL

[76] Inventor: Frank E. Cook, 1070 Martin La., Gallatin, Tenn. 37066

[21] Appl. No.: 611,892

[22] Filed: Nov. 13, 1990

[51] Int. Cl.[5] ..... B65D 19/00

[52] U.S. Cl. ..... 206/386; 206/586; 206/597

[58] Field of Search ..... 206/386, 397, 453, 586, 206/599, 597; 229/125.19

[56] References Cited

U.S. PATENT DOCUMENTS 4,830,271 5/1989 Lau et al. ..... 229/23 R X
4,871,063 10/1989 Kumbier ..... 206/386
4,915,247 4/1990 Odenthal ..... 206/453
4,986,418 1/1991 Gwathmey ..... 206/386

*Primary Examiner*—Paul T. Sewell
*Assistant Examiner*—Beth Anne Cicconi
*Attorney, Agent, or Firm*—Norman B. Rainer

[57] ABSTRACT

An adjustable cover is provided to protect articles loaded onto pallets for transportation or storage, the upper surface of the loaded articles being planar and rectangular. The cover has four cover components, each comprised of a semi-rigid sheet having a straight outer edge that attaches to a rigid angle member. The cover components are adapted to adjustably interleave upon the rectangular upper surface of the loaded articles in a manner whereby the angle members abut against the corners of the rectangular upper surface. The cover is placed in an intervening position between the load of articles and strapping bands which generally are employed to secure the load to the pallet.

2 Claims, 3 Drawing Sheets

ADJUSTABLE LOAD COVER FOR USE WITH VARIOUS SIZES OF RECTANGULARLY TOPPED STACKS OF PALLETIZED MATERIAL

BACKGROUND OF THE INVENTION

This invention relates generally to packaging materials and more particularly to a means for covering articles positioned on pallets for transportation and storage.

It is well known and common practice to position loads of various articles on wooden, metal or plastic supporting pallets for transportation and storage. Generally, such loads are bound to the pallets by tensioned metal or plastic straps or like fastening means to preclude shifting or separation thereof relative to the pallet. Typically, the straps are fastened around the load while it is compressed. When the load is decompressed, certain areas surrounding the straps remain compressed and may become indented or damaged. Heretofore, such palletized loads have been wrapped or otherwise covered with protective paper or preformed boxes to minimize the likelihood of damage to the articles during transportation and handling.

When the articles on the pallet are of a readily damagable nature, such as paper products or printed matter, it is highly desirable that a sturdy protective covering be employed to prevent damage to the articles. Such damage may commonly occur from the packing bands bending, tearing, or otherwise blemishing the articles. Further damage may occur by stacking additional loaded pallets on top of the articles during transport or storage. Protection of the load of articles has been provided in the prior art by forming a wooden frame having length and width generally corresponding to the length and width of the pallet. The wooden frame is placed on top of the load and the strapping is passed over the edges. The use of wood has a number of disadvantages including the accumulation of dirt and the presence of moisture which can transfer to the load. Moreover, wood is heavy and bulky, thereby increasing the shipping weight and considerable storage space. The wooden frames are furthermore expensive and generally not recyclable.

Some shippers have substituted the use of rigid preformed paperboard angled corners for the earlier wooden frames. In this application, laminated paperbaord which is glued, treated and formed into rigid right angles is either glued or stapled into a frame which fits down over the palletized load. A single sheet of paperboard may be interposed between this frame and the top of the load to provide protection to the top of the load. The strapping is then passed over the right angle secure the load to the pallet. This particular form of corner protection has advantages over the use of wooden frames in that it cushions the load edges against hard knocks and strap indentations, replaces expensive lumber, and provides some protection of the side of the load. On the other hand, the use of such paperbaord angles has a number of shortcomings. The corner angles must be assembled to form a frame, requiring time and labor. Such angles are unwieldy and may not be easily stored. Furthermore, such angles are normally sized specifically to only a single size of load.

In some instances, preformed cartons have been used to cover pallet loads, often resulting in a poor fit to the articles enclosed. Such cartons will often allow for the shifting of stacked articles within and the scattering of articles upon removal of the carton cover. Still other pallet covering devices have been disclosed in which flattened corrugated cardboard component panels or other paperboard material is folded over the top and sides of the pallet load. Such coverings do not provide the protection of the corner angle or wooden frame against strap indentations and hard knocks to the top corners of the load. Moreover, all of the heretofore mentioned devices must be constructed of a particular fixed size corresponding to the size of the pallet. However, in the pallet loading of certain bulk products, such as paper products or printed material, the dimensions of the top of the load may vary from pallet to pallet, depending on the dimensions of the articles in the load and the number of articles stacked upon the pallet. Furthermore, not all pallets are the same size. As a result, if preformed protective covering devices or component panels are to be employed, a variety of sizes and types must be available, creating storage and other inventory related difficulties. Often the load to be stacked upon a pallet is larger than the pallet itself. Most protective devices are limited to use in covering the stack and may not be as adapted to be interposed between the pallet and the stack to therby protect the bottom of the stack. Consequently, additional component protective devices are necessary. This situation results in an expensive packaging material problem.

For the foregoing reasons, it is highly desirable that a uniform pakaging means be devised which would adequately protect a palletized load of paper products or printed matter irrespective of the size of the load.

It is accordingly an object of the present invention to provide a protective covering device having dimensions adaptable to various sizes of pallet-loaded stacks of material.

It is another object of the present invention to provide a device of the aforesaid nature which will protect the edges of said stacks of material from indentation by tensioned strapping bands and other forces.

It is another object of the present invention to provide a device of the aforesaid nature which may be interposed between the pallet and the bottom of the load to thereby render protection from damage to the bottom edges of the load.

It is still another object of the present invention to provide a device of the aforesaid nature which may be easily assembled and sized.

It is yet another object of the present invention to provide a device of the aforesaid nature which is comprised of a minimal number of component parts.

These objects and other objects and advantages of the invention will be apparent from the following description.

SUMMARY OF THE PRESENT INVENTION

The above and other beneficial objects and advantages are accomplished in accordance with the present invention by a load cover adapted for use with a variety of sizes of rectangularly topped stacks of material loaded upon a pallet, said stacks terminating in an upper surface having a central region bounded by four side corners in generally rectangular disposition, said stack being adapted to be surroundively bound to said pallet by tensioned strapping bands, said load cover being comprised of four cover components, each comprised of:

a) a semi-rigid sheet having flat top and bottom surfaces and a perimeter comprised of a straight outer edge joining with an interiorly directed boundary extending a distance from said outer edge no greater than the length of said outer edge and defining a perimeter having a line of symmetry that perpendicularly bisects said outer edge, and b) a rigid elongated performed angle member having top and side panels, said top panel fixedly associated with the outer edge of said sheet, said side panel orthogonally emergent from said top panel.

The four cover components are configured to overlay the upper surface of said stack with the bottom surfaces of said sheets in contact with said upper surface of the stack, the interiorly directed boundary of each sheet being directed toward said central region and intersecting the interiorly directed boundary of at least two other sheets. Each of said angle members is adapted to protectively engage one of said corner edges. The cover is configured to be interposed between the upper surface of the stack and the surrounding strapping bands.

In preferred embodiments, said sheets are constructed from paperboard stock such as corrugated cardboard, and said angle members are constucted from laminated sheets of paperboard such as corrugated cardboard, and preformed to a continuous bend which will generally dispose said top and side panels at a right angle.

In some embodiments, said sheets may be interposed between the pallet and the bottom of said stack with said angle members upwardly directed to accordingly protect the bottom corners of the stack.

In alternative embodiments, the interiorly directed boundary of the sheets may be comprised of paired parallel side edges joined to an interior edge. The interiorly directed boundary may also have a multiplicity of flaps defined by slits in the sheet emergent upon said interior edge. The flaps of each cover component are adapted to be interleaved with the corresponding flaps of opposed cover components in a telescopically expandable and contractible manner.

In some embodiments, the cover components may be dissimilar in size, shape, number of flaps and materials of construction, yet have interleaving flaps.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
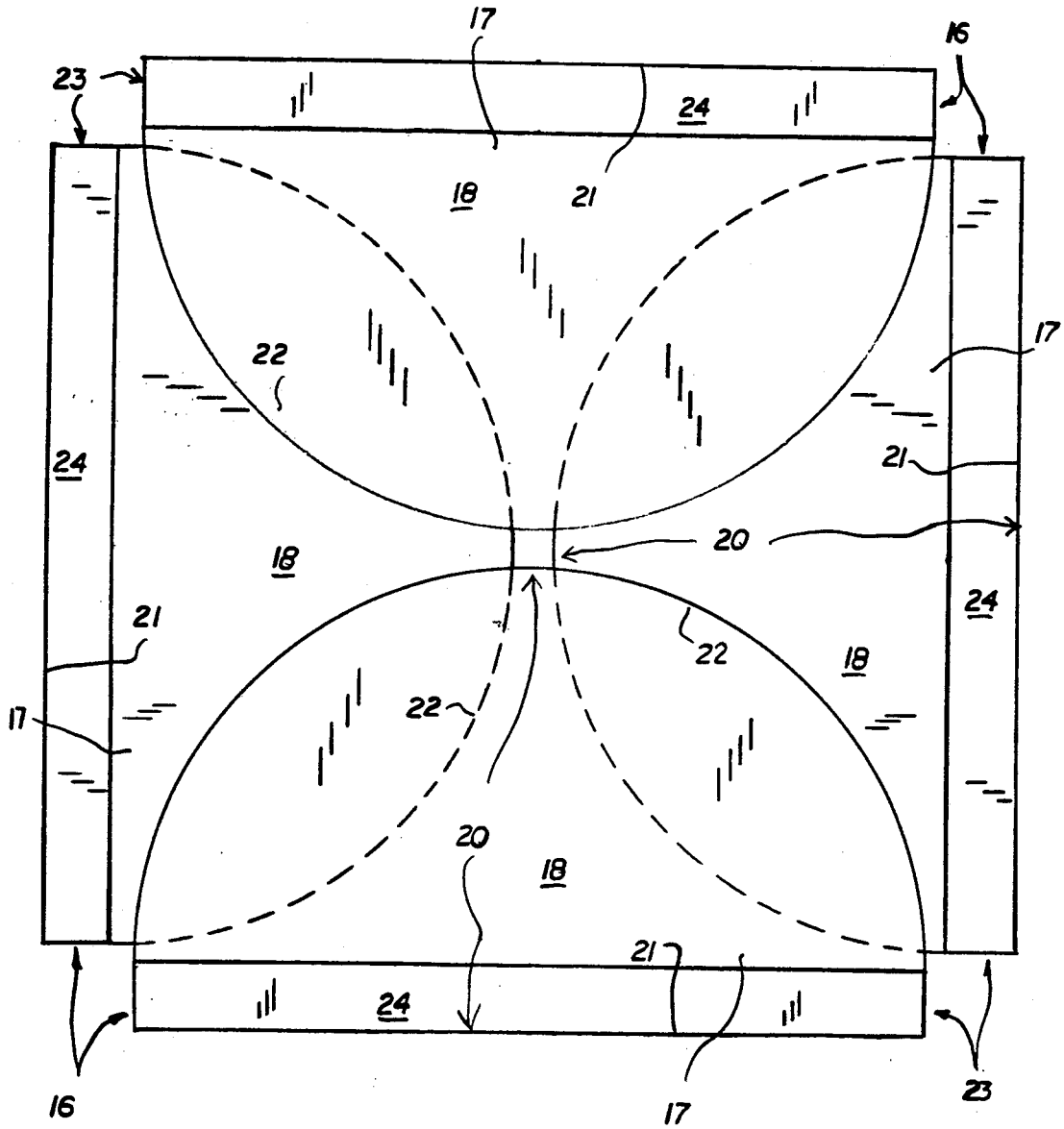
FIG. 1 is a top view of an embodiment of the load cover of the present invention.
Figure 2:
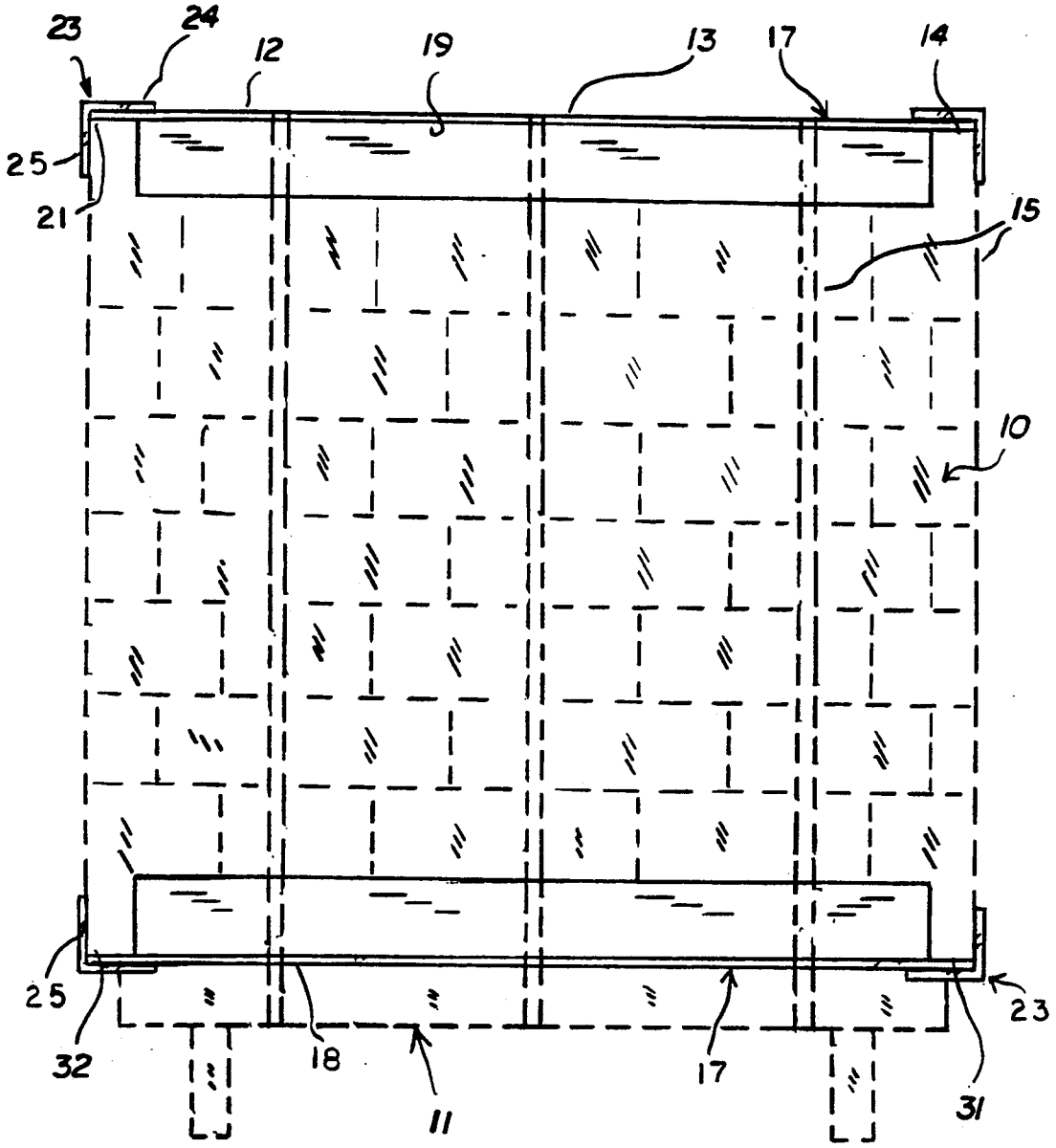
FIG. 2 is a side view of the embodiment of FIG. 1 shown in operative association with a loaded pallet.

Referring to FIGS. 1-2, an embodiment of the load cover of the present invention is shown operably positioned upon a rectangularly topped stack of material 10 loaded upon pallet 11. Stack 10 terminates in upper surface 12 having a central region 13 bounded by four side corners 14 in generally rectangular disposition. Stack 10 is adapted to be surroundively bound to pallet 11 by tensioned strapping bands 15. The load cover is comprises of four cover components 16. Each cover component is comprised of a semi-rigid sheet 17 having flat top and bottom surfaces 18 and 19, respectively, and perimeter 20 comprised of straight outer edge 21 joining with interiorly directed boundary 22 extending a distance from outer edge 21 no greater than the length of outer edge 21 and defining a continuous circuitous perimeter having a line of symmetry that perpendicularly bisects outer edge 21. Boundary 22, in the embodiment of FIG. 1, has a substantially semi-circular contour.

Rigid elongated preformed angle member 23 has top and side panels 24 and 25, respectively. Top panel 24 is fixedly associated with outer edge 21. Side panel 25 is a continuous integral extension of top panel 24 and extends generally orthogonally therefrom. The four cover components 16 are configured to overlay upper surface 12 with the bottom surfaces 19 in contact with upper surface 12. Interiorly directed boundaries 22 are directed toward central region 13. Each of said angle members 23 are adapted to protectively engage one of side corners 14. The cover is configured to be interposed between the upper surface 12 and surrounding strapping bands 15. As illustrated in FIG. 2, the load cover of this invention may also be interposed between pallet 11 and the bottom surface 31 of load 10, in which case, side panels 25 are upwardly directed to similarly protect bottom corners 32 from packing bands 15.

Figure 3:
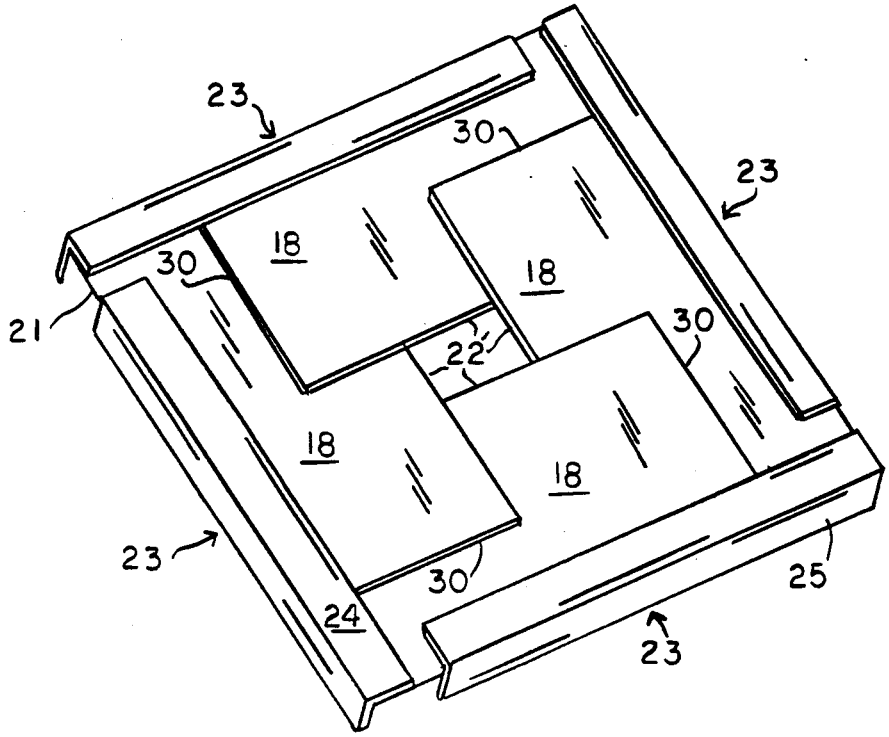
FIG. 3 is a perspective top view of an alternative embodiment of the load cover of the present invention.
Figure 4:
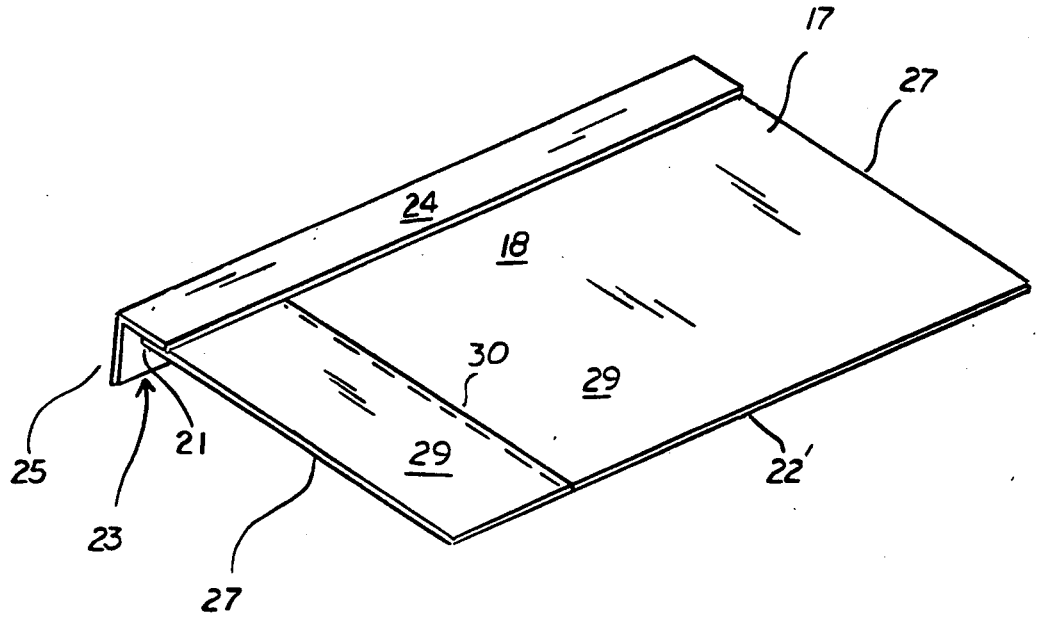
FIG. 4 is a perspective view of an individual cover component of the embodiment of the load cover of FIG. 3.

In the alternative embodiment shown in FIGS. 3 and 4, parallel side edges 27 of each cover component are perpendicularly disposed to outer edge 21, and extend to straight inner edge 22'. The sheet has co-planar flaps 29, bounded in part by side edge 27, inner edge 22', and linear penetrative slit 30. The slit extends orthogonally from inner edge 22' toward outer edge 21. The flaps of each component are adapted to be interleaved with the corresponding flaps of an opposed cover component to create a telescopically expandable and contractable load cover.

It is to be noted that interiorly directed boundary 22 or 22', whether of curved integral configuration as in the embodiment of FIG. 1, or of rectilinear construction as in the alternative embodiment of FIGS. 3 and 4, intersects the interiorly directed boundaries of at least two other cover components.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A load cover for use with a variety of sizes of rectangularly topped stacks of material loaded upon a pallet, said stacks terminating in an upper surface having a central region bounded by four side edges in generally rectangular disposition, said stack configured to be surroundively bound to said pallet by tensioned strapping bands, said load cover comprised of four identical cover components, each comprised of:

a) a semi-rigid sheet having flat top and bottom surfaces and a perimeter comprised of a straight outer edge joining with an interiorly directed boundary extending a distance from said outer edge no greater than the length of said outer edge and having at least two co-planar flaps defined by slits in said semi-rigid sheet, said perimeter having a line of symmetry that perpendicularly bisects said outer edge, and b) a rigid elongated preformed angle member having top and side panels, said top panel fixedly associated with said outer edge, said side panel joined to said top panel and extending downwardly therefrom, said four cover components configured to overlay said stack in opposed telescopically adjustable relationship wherein the interiorly directed boundary of any one cover component intersects the interiorly directed boundaries of at least two other cover components, and the flaps of each cover component slidably interleave with corresponding flaps of an opposed cover component.

2. A covered palletized load comprising:

a) a pallet, b) a rectangularly topped stack of material loaded upon said pallet, said stack terminating in an upper surface having a central region bounded by four side edges in generally rectangular disposition, c) a cover comprised of four identical components, each comprised of a semi-rigid sheet having flat top and bottom surfaces and a perimeter comprised of a straight outer edge joining with an interiorly directed boundary extending a distance from said outer edge no greater than the length of said outer edge and defining a perimeter having a line of symmetry that perpendicularly bisects said outer edge, and a rigid elongated preformed angle member having top and side panels, said top panel fixedly associated with said outer edge, said side panel joined to said top panel and extending downwardly therefrom, said four cover components overlying the upper surface of said stack in opposed telescopically adjustable relationship with the bottom surfaces of said sheets in contact with said upper surface, said interiorly directed boundaries directed toward said central region, each of said angle members protectively engaging one of said side edges, and d) strapping bands that surround said pallet, stack and cover.

* * * * *